US008615942B2

(12) United States Patent
Lafreniere

(10) Patent No.: US 8,615,942 B2
(45) Date of Patent: Dec. 31, 2013

(54) METAL HEADER FRAME FOR A BUILDING WALL

(75) Inventor: Dennis P. Lafreniere, Duarte, CA (US)

(73) Assignee: Lafreniere Construction Concepts, LLC, Duarte, CA (US)

( * ) Notice: Subject to any disclaimer, the term of this patent is extended or adjusted under 35 U.S.C. 154(b) by 408 days.

(21) Appl. No.: 11/179,114

(22) Filed: Jul. 11, 2005

(65) Prior Publication Data

US 2006/0010809 A1 Jan. 19, 2006

Related U.S. Application Data

(60) Provisional application No. 60/588,926, filed on Jul. 16, 2004.

(51) Int. Cl.

| | |
|---|---|
| ***E04B 1/00*** | (2006.01) |
| ***E04B 1/38*** | (2006.01) |
| ***E04C 2/38*** | (2006.01) |
| ***E04C 3/02*** | (2006.01) |
| ***E04C 5/00*** | (2006.01) |

(52) U.S. Cl.
USPC ..... 52/204.2; 52/289; 52/702; 52/715; 52/656.4

(58) Field of Classification Search
USPC ..... 52/289, 690, 204.2, 210, 481.2, 579, 52/636, 800.12, 634, 657, 730.6, 702, 712, 52/715, 215, 729.1, 204.1, 653.1, 655.1, 52/565.1, 656.2, 656.4, 656.9
See application file for complete search history.

(56) References Cited

U.S. PATENT DOCUMENTS

| | | | | | |
|---|---|---|---|---|---|
| 625,427 | A | * | 5/1899 | Stewart | 403/190 |
| 3,036,347 | A | * | 5/1962 | Findleton | 403/217 |
| 3,633,950 | A | * | 1/1972 | Gilb | 403/384 |
| 4,021,988 | A | | 5/1977 | Edeus et al. | |
| 4,067,157 | A | | 1/1978 | Robinson | |
| 4,481,749 | A | | 11/1984 | Stirling | |
| 4,717,279 | A | * | 1/1988 | Commins | 403/187 |
| 5,189,857 | A | | 3/1993 | Herren et al. | |
| 5,664,392 | A | * | 9/1997 | Mucha | 52/715 |
| 5,689,922 | A | | 11/1997 | Daudet | |
| 5,771,644 | A | | 6/1998 | Kidd | |
| 5,846,018 | A | * | 12/1998 | Frobosilo et al. | 403/403 |
| 5,906,080 | A | * | 5/1999 | diGirolamo et al. | 52/243.1 |
| 5,941,044 | A | * | 8/1999 | Sera | 52/655.1 |

(Continued)

OTHER PUBLICATIONS

Internet web site http://www.steelnetwork.com entitled StiffClip HE (2 pages).

(Continued)

*Primary Examiner* — Ryan Kwiecinski
(74) *Attorney, Agent, or Firm* — Lowry Blixseth LLP; Scott M. Lowry

(57) ABSTRACT

An improved metal or steel header frame is provided for use in a metal framed building wall or the like, wherein the header frame is adapted for quick and easy installation to span a framed opening such as a door or window opening in the building wall. The improved header frame includes a pair of metal bracket clips adapted for screw-on and/or bolt-on attachment to a pair of jamb studs disposed at opposite sides of the door or window opening. These bracket clips define support lands for vertically supporting opposite ends of an elongated header stud which can be quickly and easily seated thereon to span the door or window opening, and attached thereto by one or more suitable fasteners such as screws.

19 Claims, 5 Drawing Sheets

(56) References Cited

U.S. PATENT DOCUMENTS

| | | | | |
|---|---|---|---|---|
| 6,189,277 | B1 | 2/2001 | Boscamp | |
| 6,230,466 | B1 * | 5/2001 | Pryor | 52/702 |
| 6,260,318 | B1 | 7/2001 | Herren | |
| 6,398,193 | B1 * | 6/2002 | DeSouza | 256/65.06 |
| 6,609,344 | B2 | 8/2003 | Saldana | |
| 6,612,087 | B2 * | 9/2003 | diGirolamo et al. | 52/712 |
| 6,799,407 | B2 | 10/2004 | Saldana | |
| 6,799,408 | B2 | 10/2004 | Brady | |
| 7,216,465 | B2 * | 5/2007 | Saldana | 52/655.1 |
| D640,916 | S * | 7/2011 | Sias | D8/382 |
| D644,503 | S * | 9/2011 | Crane et al. | D8/382 |
| 8,540,201 | B2 * | 9/2013 | Gadd et al. | 248/300 |
| 2002/0062617 | A1 * | 5/2002 | diGirolamo et al. | 52/688 |
| 2005/0066611 | A1 * | 3/2005 | Brady | 52/633 |
| 2006/0096192 | A1 * | 5/2006 | Daudet | 52/204.1 |
| 2006/0096201 | A1 * | 5/2006 | Daudet | 52/272 |

OTHER PUBLICATIONS

Internet web site http://www.strongtie.com entitled Simpson Strong-Tie/HH Header Hangers (2 pages).

* cited by examiner

METAL HEADER FRAME FOR A BUILDING WALL

This application claims the benefit of U.S. Provisional Application 60/588,926, filed Jul. 16, 2004.

BACKGROUND OF THE INVENTION

This invention relates generally to improvements in building construction systems and methods, and more particularly to an improved metal or steel header frame for spanning a mechanical, electrical, plumbing, door or window or opening or the like in a framed building wall. More specifically, this invention relates to an improved metal jamb and header frame and related assembly adapted for use in a metal framed building wall or the like, wherein the invention facilitates rapid and structurally stable installation of a metal header stud spanning a wall opening.

In many commercial buildings, the various stud and header components used for framing a building wall comprise metal structures such as relatively lightweight or light gauge components formed from galvanized steel or the like. In this regard, a typical metal stud used for framing a building wall has an elongated, relatively thin-walled and essentially hollow construction approximating the cross sectional dimension of a conventional wood two-by-four used in traditional wood frame construction. In accordance with conventional metal frame construction techniques, such metal studs are normally connected in a vertically extending and parallel spaced-apart orientation between metal lower sole and upper header plates by means of suitable threaded fasteners such as self-tapping screws or the like, thereby facilitating relatively rapid yet structurally sturdy assembly of the wall frame components. The resultant skeletal wall frame may incorporate suitable utility lines and/or conduits, and/or insulation material prior to sheathing with finishing material such as drywall, plaster, interior/exterior paneling or siding materials and the like. These finishing products, in combination with the metal stud framing, can provide hourly fire resistance or fire retardation rates compatible with local building codes provided, of course, that Underwriter's Laboratory (UL) and local building code requirements are followed.

Modern building construction methods commonly incorporate building walls in the form of a skeletal frame structure defined by a plurality of vertically oriented studs extending in parallel spaced-apart relation between a lower or bottom runner or sole plate, and an upper track or header plate. Framed openings, particularly in heavy grade commercial construction such as hospitals and schools, are typically defined by two welded jamb studs or king studs extending vertically on opposite sides of the opening, in combination with two header studs and multiple header tracks which are field cut to length and overlapped with the adjacent vertical stud flanges at appropriate elevations to insure a positive connection between building components.

As a result of this added build-up, two problems are presented. The first is that the hourly fire code rating of the opening and adjacent wall structure is affected by the inability of the finishing product to rest flush against the metal stud framing. For example, at a rated door opening the drywall is required to nest to the inside of the door frame, but due to the build-up of overlapping components at the inside corner connection points, typically (but in violation of building codes) the door frame is altered by bending tabs on the metal frame components or drywall finishing material is back-cut to accommodate the unforeseen added dimensions. Both of these alteration techniques void the requisite hourly fire code ratings for the opening. The second problem pertains to build-up of material at the connecting corners of the header studs/tracks to the jamb studs, wherein this build-up results in unsightly bulges and cracks in the finishing material thereby decreasing the quality of the finished wall. Significant time, material and labor is required to correct these problems.

In the past, multiple metal header studs and tracks spanning the top and bottom of a framed door, window or other mechanical opening, and a pair of metal jamb or king studs on opposite sides of the opening, have commonly been connected together and to the associated jamb studs by welding. Also, prior to the present invention, a metal framed stud building requiring a "chase" wall or two walls parallel to each other to accommodate mechanical and plumbing lines and the like, and further incorporating a framed opening for a door or window or mechanical duct or the like, could only be framed with the use of added stud gusset plates, straps and brackets due to the inability to weld inside or interior points of attachment. The use of these added parts and the requisite installation labor has been directly due to the inability to make connections to, through and around such adjacent parallel walls.

Unfortunately, such welding steps require the use of specialized and typically certified welding personnel, expensive welding equipment, and associated specialty inspectors to inspect and approve completed welds. Moreover, each weld represents a relatively time-consuming task that must be performed with considerable precision and care. As a result, in a heavy duty commercial metal framed construction project such as a hospital or school having numerous mechanical, electrical, plumbing, medical gas, door and/or window openings each presenting a fire-life-safety concern, the cost associated with jamb and header metal stud framing can be substantial.

Another problem that exists in the conventional or commonly used method of framing such mechanical openings is the inability to a dust or rework an opening due to a variety of occurrences in commercial framing. For example, changes made by the architect or owner, out-of-level concrete floors, and out-of-square framed openings all require adjustment and reworking of the opening. Current assembly methods require complete or substantially complete dismantling of the opening-forming structure, without the ability to level or square framing components.

There exists, therefore, a significant need for improvements in and to metal frame construction systems and methods, wherein metal jamb and header studs spanning building openings can be installed quickly and easily and in a structurally sturdy and stable manner, to provide a finished product of high quality and reduced construction cost, without requiring welding or the time and labor costs associated therewith, and further without jeopardizing or comprising fire code ratings. The present invention fulfills these needs and provides further related advantages.

SUMMARY OF THE INVENTION

In accordance with the invention, an improved metal or steel header/jamb frame system and related installation method are provided for use in a metal framed building wall, wherein the header frame is adapted for quick and easy installation of jamb/king studs and a header stud to span an opening such as a door or window opening or the like formed in the building wall. The framed wall opening is defined between a pair of vertically oriented jamb studs formed preferably with a geometry and from a suitable gauge metal according to building wall design criteria. The improved header frame includes a pair of metal bracket clips adapted for screw-on and/or bolt-on attachment respectively and universally to the associate pair of vertical jamb studs at a selected vertical elevation. These bracket clips define support flanges and lands or ledges for vertically receiving and supporting an elongated header stud which can be quickly and easily seated thereon to span the framed opening, and attached thereto by one or more suitable fasteners such as screws or the like.

In a preferred form, each bracket clip has a unitary or one-piece construction formed from a suitable gauge metal such as galvanized sheet steel or the like. Each bracket clip may be formed as a blank cut from metal sheet stock and then folded to define a base wall for secure attachment abutted directly to the associated jamb stud by means of one or more screws and/or bolts or the like. At least one support land or ledge is turned horizontally relative to the base wall and thereby defines a horizontally oriented surface for vertically supporting one end of the associated header stud. In the preferred form, each bracket clip further includes a pair of laterally disposed and generally vertically oriented flanges or wing walls turned at a right angle relative to the base wall, and cooperating with the support land or lands to define an upwardly open pocket for relatively close tolerance slide-fit seated reception and support of the header stud end. The support land or lands and the wing walls of the bracket clip are adapted for secure connection to the header stud as by means of suitable fasteners, such as self-tapping screws or the like.

The base wall of each bracket clip may include one or more preformed or pre-cut apertures for facilitated reception of the associated fasteners such as screws and/or bolts for securely affixing the bracket clip to the adjacent jamb stud. In one preferred form, such pre-cut apertures include at least one vertically elongated slot for receiving a fastener such as a mounting bolt or screw, wherein the bracket clip can be vertically adjusted for precise vertical positioning relative to the adjacent jamb stud prior to secure tightening of the mounting bolt or screw and any additional adjacent fasteners such as self-tapping screws or the like. In addition, a strengthening or reinforcing rib can be formed to extend vertically along the clip base wall, preferably at a generally centered position, for resisting loads applied thereto.

The width of the bracket clip is selected to correspond substantially with the width of the associated jamb stud, thereby avoiding overlapping components of the type resulting in undesirable build-up or increase in wall thickness that can otherwise interfere with subsequent mounting of finishing materials such as drywall or the like.

The header stud may comprise a metal stud framing component incorporating a strengthening or reinforcing rib. In a preferred form, a secondary reinforcing sleeve may be seated within the header stud for further increasing load capacity.

Other features and advantages of the present invention will become apparent from the following more detailed description, taken in connection with the accompanying drawing which illustrate, by way of example, the principals of the present invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
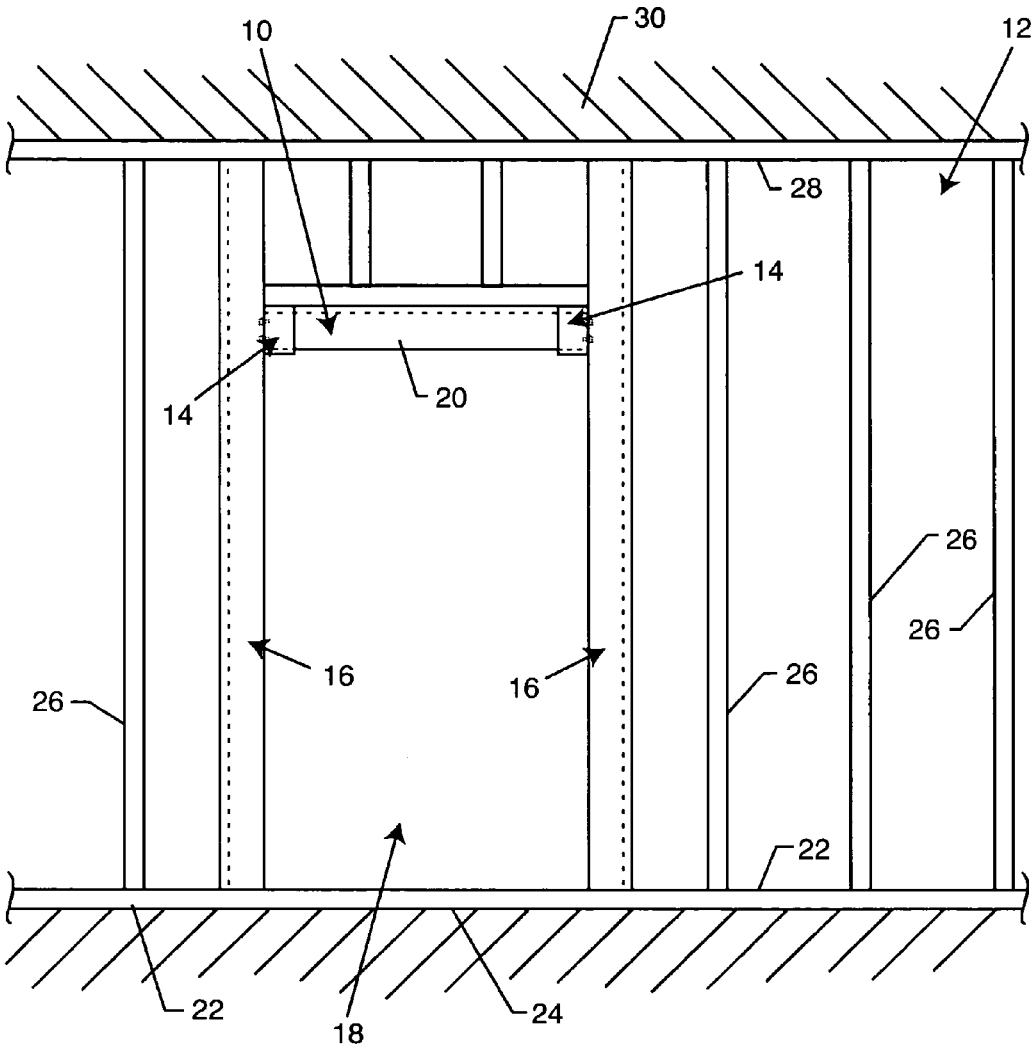
FIG. 1 is a fragmented elevation view depicting a framed building wall incorporating a metal header frame embodying the novel features of the present invention.
Figure 2:
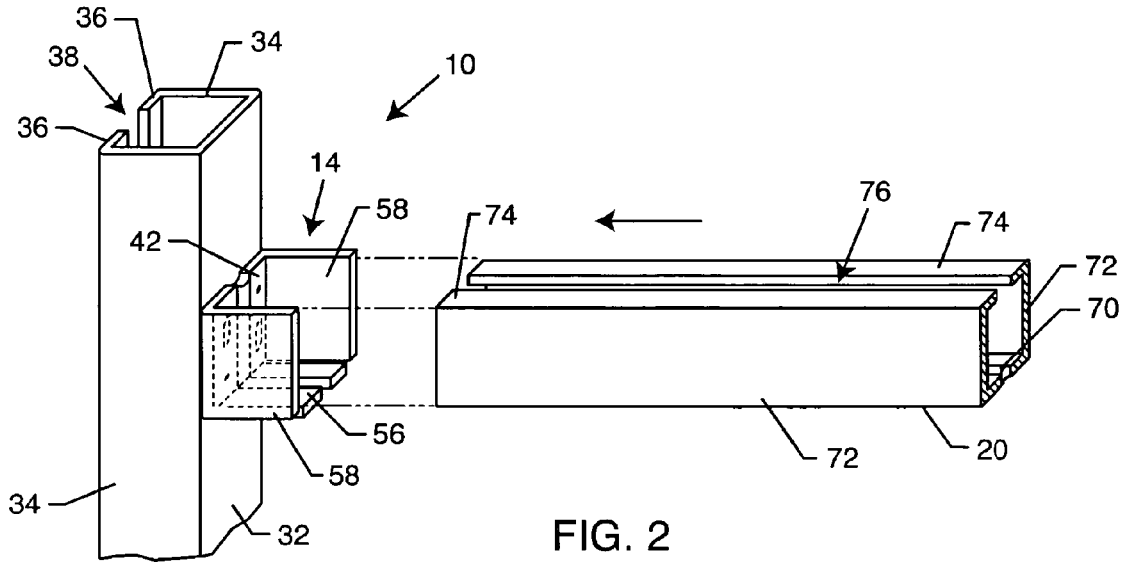
FIG. 2 is a fragmented and partially exploded perspective view showing a bracket clip installed onto a jamb stud, wherein the bracket clip is adapted for receiving and supporting one end of a header stud.
Figure 3:
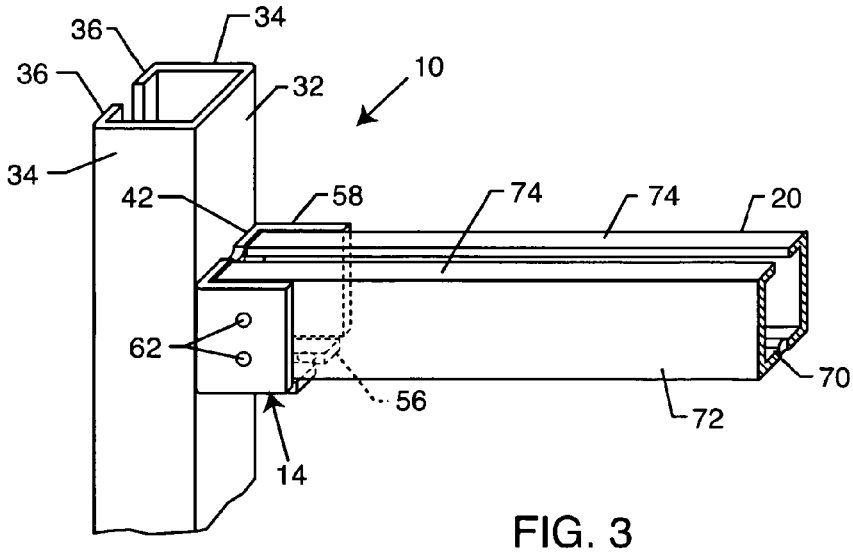
FIG. 3 is a fragmented perspective view similar to FIG. 2, but illustrating the header stud supported on and attached to the bracket clip.

As shown in the exemplary drawings, an improved header frame referred to generally in FIGS. 1-3 by the reference numeral 10 is provided for use in a framed building wall 12. The improved header frame 10 includes a pair of bracket clips 14 designed for quick and easy yet structurally stable and secure mounting onto a pair of vertically oriented jamb studs 16 lining a framed opening formed in the building wall 12, such as the illustrative door opening 18 depicted in FIG. 1. The bracket clips 14 are adapted for supporting a transversely or horizontally oriented header stud 20 in a position spanning the top of the framed opening 18.

The improved header frame 10 of the present invention is particularly adapted for use in metal frame building construction wherein the building wall 12 comprises a skeletal frame constructed from metal framing materials. In this regard, as viewed in FIG. 1, and in accordance with conventional metal framing methods, the building wall 12 generally comprises a bottom runner or sole plate 22 designed for suitable bolt-on, powder actuated fastener, or similar attachment to a floor surface 24. A plurality of metal studs 26 are attached to this sole plate 22 by suitable fasteners such as self-tapping screws or the like, and extend upwardly in a vertically parallel array for attachment by additional fasteners such as self-tapping screws or the like to an upper track or header plate 28. This header plate 28 is suitably connected in turn to a ceiling structure 30. The sole and header plates 22 and 28, as well as the metal studs 26, are typically constructed from a relatively lightweight or light gauge metal such as galvanized steel or the like to have a substantially hollow construction approximating the cross sectional dimension of a conventional wood two-by-four used in traditional wood frame construction.

Within the thus-framed building wall 12, one or more openings may be included, such as a window or door opening, as well as other types of openings for accommodating mechanical pneumatic, electrical, and plumbing equipment and the like. FIG. 1 illustrates an exemplary framed opening in the form of a single door opening 18 lined on opposite side edges by the vertically oriented pair of jamb studs 16 adapted for suitable connection between the sole and header plates 22, 28. These jamb studs 16 may be constructed from a relatively stronger or heavier gauge metal material, in comparison with the metal studs 26, for defining and/or supporting a door frame (or other opening) within which a door (or other component or structure, not shown) may be hingedly installed. The bracket clips 14 provide a convenient and easily installed structure at the top of the framed opening 18 for securely supporting the associated header stud 20, which may also be formed from a stronger or heavier gauge metal material similar to that used for the jamb studs 16. In a window opening and other types of framed openings (not shown), persons skilled in the art will recognize and understand that bracket clips 14 may be installed in pairs at both the top and bottom margins of the framed opening for supporting a pair of header studs 20 spanning or lining these upper and lower margins of the framed opening.

Figure 6:
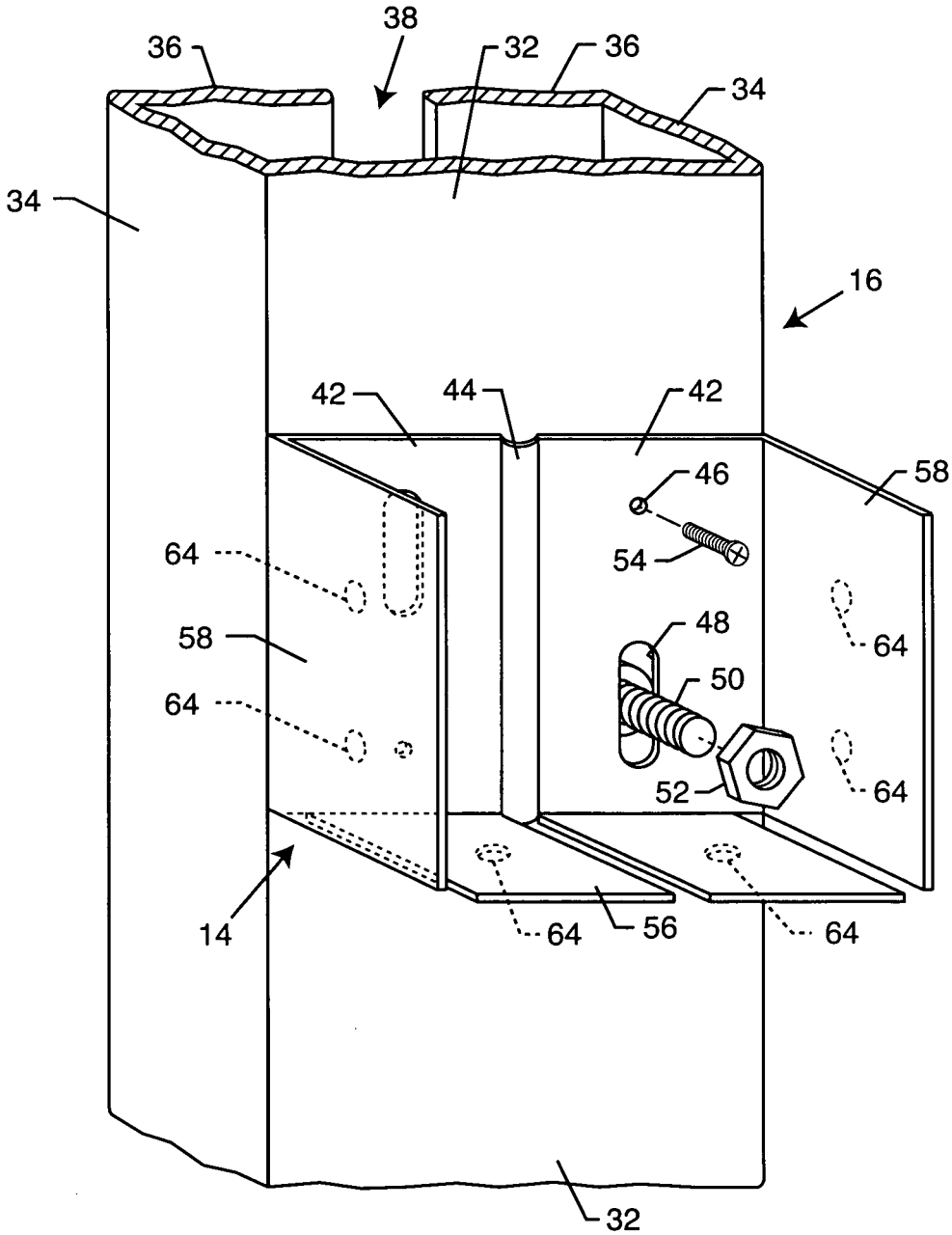
FIG. 6 is a fragmented and partially exploded perspective view showing installation of a bracket clip onto a jamb stud.

One of the jamb studs 16 is shown in more detail in FIGS. 2-3 and 6. As shown, the illustrative jamb stud 16 includes an elongated side wall or web 32 joined along its opposite longitudinal margins to a pair of comparatively narrower end walls 34 turned substantially at right angles thereto. The opposite margins of these end walls 34 are joined in turn to pair of short side strips 36 which are in-turned generally parallel to the web 32, and define an elongated narrow slot 38 therebetween. These jamb stud wall components 32, 34 and 36 cooperatively define a relatively lightweight and substantially hollow stud construction having high strength particularly in longitudinal compression. Each jamb stud 16 is normally oriented with the side wall or web 32 thereof facing inboard relative to the associated framed opening, and supports the associated header stud or studs 20 relative to the framed opening.

Figure 4:
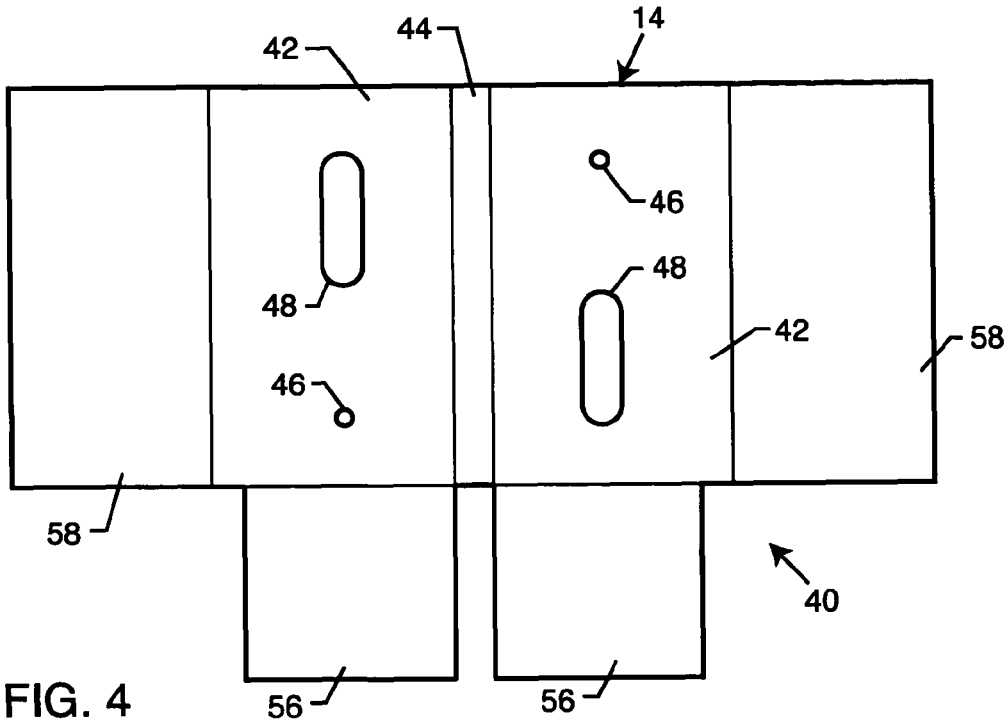
FIG. 4 is an enlarged plan view of a metal sheet stock blank pre-cut for use in forming a bracket clip.
Figure 5:
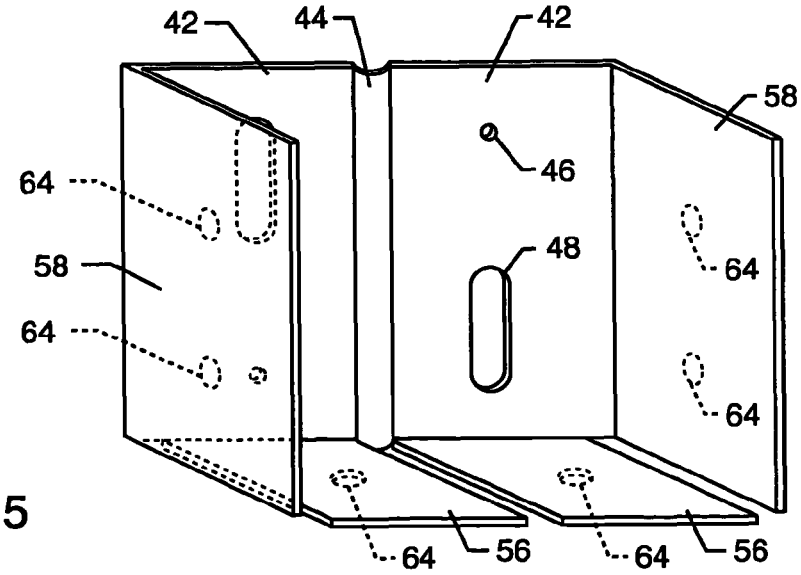
FIG. 5 is a perspective view of a bracket clip formed from the pre-cut blank shown in FIG. 4.

Each bracket clip 14, in accordance with a preferred form of the invention, may have a unitary construction formed from metal sheet stock as by cutting a preformed or pre-cut blank 40 (FIG. 4) from sheet metal or the like and then folding or shaping the bracket clip 14 into a desired finished geometry as viewed in FIG. 5. In this regard, each bracket clip 14 comprises a generally planar base wall 42 having a size and shape for secure and stable seated engagement abutted substantially flush against the jamb stud web 32 at a selected vertical position lining the inboard side of the framed opening 18. FIGS. 4-5 show the base wall 42 subdivided by a vertically oriented central strengthening or reinforcing rib 44, with a pair of small screw ports 46 and a corresponding pair of vertically elongated bolt or screw slots 48 formed on opposite sides of this central rib 44. Fasteners such as mounting bolts or screws 50 (FIG. 6) can be fastened through the jamb stud web 32 and associated slots 48 in the bracket clip 14, followed by precision vertical adjustment of the bracket clip position before, e.g., tightening threaded nuts 52 onto the illustrative mounting bolts 50. Additional screw-type fasteners 54 may be secured through the screw ports 46 and fastened into the jamb stud web 32. Alternately, in some installations, it may be desirable or preferable to install the fasteners 50 and 54 in a reverse orientation to extend through the jamb stud web 32 into secure engagement with the clip base wall 42.

FIG. 5 shows the bracket clip 14 to further include a a pair of horizontally oriented support lands or ledges 56 turned outwardly from a lower margin of the clip base wall 42. These support lands 56 cooperatively have a size and shape for secure and stable support of one end of the associated header stud 20 used to span the framed opening 18. These support lands 56 conveniently eliminate the need for precision cutting of the associated header stud 20, by allowing for in-field adjustments on the support lands. For additional structural stability and facilitated positioning of the header stud 20, the bracket clip 14 may further include a pair of generally parallel wing walls or flanges 58 turned in parallel at right angles from the opposite side margins of the base wall 42, wherein the support lands 56 and the wing walls 58 cooperatively define an upwardly open or generally U-shaped pocket 60 for simple slide-fit or drop-in or slide-in, relatively close tolerance seated placement of the associated end of the header stud 20 as viewed in FIGS. 2-3. When the end of the header stud 20 is seated within bracket clip pocket 60, suitable fasteners such as self-tapping screws 62 (FIG. 3) or the like may be used to fasten the bracket clip 14 and header stud 20 securely together. Alternately, preformed screw ports 64 may be formed in the support lands 56 and/or the wing walls 58 as depicted in dotted lines in FIG. 5.

In accordance with one important feature of the invention, the width of each bracket clip 14 is selected for conformance with the width dimension of the web 32 on the associated jamb stud 16. That is, the combined width of the bracket clip 14 as defined by the base wall 42 and the wing walls 58 generally corresponds with but does not exceed the width of the jamb stud web 32. With this construction, the bracket clip 14 when assembled with the jamb stud 16 and the associated header stud 20, does not produce an undesirable build-up or overlap of components that would otherwise interfere with subsequent flush-mounted installation of finishing material such as drywall or the like.

Figure 7:
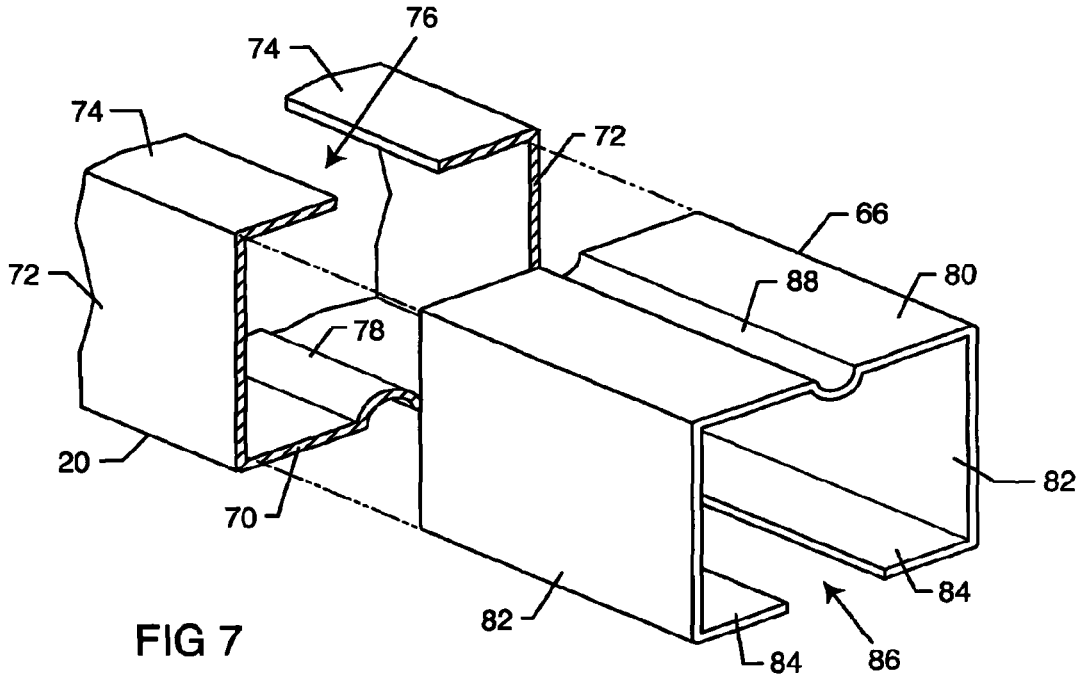
FIG. 7 is an fragmented and exploded perspective view showing a reinforcement sleeve for slide-fit reception into a header stud.
Figure 8:
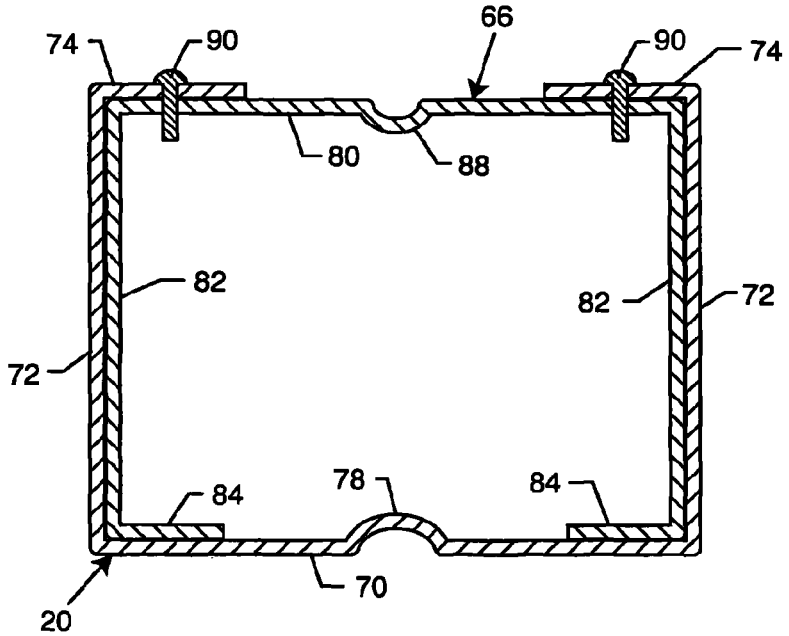
FIG. 8 is a cross-sectional view depicting the reinforcement sleeve mounted within and attached to a header stud.

FIGS. 7 and 8 illustrate a metal reinforcing sleeve 66 for slide-fit installation into the hollow interior of the header stud 20, wherein the reinforcing sleeve 66 is adapted particularly for use with longer header studs 20 which may be subjected in use to vertical loads of greater magnitude. As shown, the metal header stud 20 incorporates a side wall or web 70 joined at opposite side margins to a pair of end walls 72 turned substantially at right angles thereto, and wherein the opposite margins of these end walls 72 are joined in turn to pair of short side strips 74 which are in-turned generally parallel to the side wall 70 and define an elongated narrow slot 76 therebetween. This header stud 20 is normally installed to span the framed opening 18 with the side wall 70 thereof facing inboard relative to the associated framed opening.

The reinforcing sleeve 66 has a similar cross sectional configuration to include a side wall or web 80 joined to a pair of parallel-oriented end walls 82, which are joined in turn to a respective pair of side strips 84 defining a narrow slot 86 therebetween. However, the cross sectional size of the reinforcing sleeve 66 is slightly smaller than that of the header stud 20, so that the reinforcing sleeve 66 can be slide-fit and frictionally nested therein. In this regard, in a preferred configuration, the reinforcing sleeve is inverted relative to the header stud, so that sleeve side wall 80 interfits at the inboard surface of the stud side strips 74 whereas the sleeve side strips 84 interfit at the inboard surface of the stud side wall or web 70. Central strengthening or reinforcing ribs 78 and 88 may also be formed within the respective side walls 70 and 80, for slide-fit reception within the respective slots 76 and 86. The length of the reinforcing sleeve 66 may be variably selected, and the sleeve 66 may be freely nested within the header stud 20 or otherwise securely fastened thereto as by means of suitable fasteners such as self-tapping screws 90 (FIG. 8) or the like.

The improved header frame 10 of the present invention thus provides a simple frame structure for securely mounting the header stud to span a door or window or other framed opening formed in a framed or partially framed metal wall structure. The bracket clips 14 are quickly and easily installed in pairs, at individually selected appropriate vertical positions at the opposite sides of the framed opening, followed by similarly quick and easy mounting of the associated header stud. Importantly, this assembly of components does not require any welding step, and beneficially eliminates component build-up at inside corners of the framed opening. Accordingly, concerns for jeopardizing and/or compromising the fire safety rating of the constructed wall, and/or the need for time-intensive and labor-intensive remedial action to correct such problems are substantially eliminated.

Although an embodiment has been described in detail for purposes of illustration, various modifications may be made without departing from the scope and spirit of the invention. Accordingly, no limitation on the invention is intended by way of the foregoing description and accompanying drawings, except as set forth in the appended claims.

What is claimed is:

1. A bracket clip, comprising:

a base wall for mounting flush with an associated jamb stud and having at least one fastener port formed therein for reception therethrough of at least one securement fastener for attaching said base wall to the associated jamb stud;

a vertically elongated and inwardly extending strengthening rib subdividing said base wall;

a pair of horizontally oriented load-bearing support lands extending perpendicularly from said base wall and separated by an open edge accessible channel linearly aligned with and perpendicular to said inwardly extending strengthening rib, for vertically supporting an associated end of a header stud; and a pair of flanges having planar surfaces oriented perpendicular to said base wall and said pair of support lands, each of which cooperate to form a three-sided pocket for receiving said header stud therein, said flanges prohibiting outward transverse movement of a pair of header stud sidewalls when mounted within said three-sided pocket.

2. The bracket clip of claim 1, wherein said flanges are dimensioned relative to one another to respectively align flush with a pair of jamb stud outer walls.

3. The bracket clip of claim 1, wherein said pair of header stud sidewalls respectively mount flush with and between said flanges.

4. The bracket clip of claim 1, wherein said flanges comprise a planar surface.

5. The bracket clip of claim 1, wherein said bracket clip comprises a unitary construction.

6. The bracket clip of claim 1, wherein the base wall includes a pair of alignment slots for reception therethrough of a respective positioning fastener for attaching said base wall flush with said associated jamb stud to accommodate vertical positional adjustment of said bracket clip and associated header stud relative to said jamb stud while simultaneously preventing horizontal movement.

7. The bracket clip of claim 6, wherein said at least one securement fastener positionally locks horizontal and vertical movement of said bracket clip relative to the associated jamb stud when received through said fastener port.

8. A combination for a framed wall assembly, comprising:

a pair of bracket clips each respectively having a base wall for mounting flush with an associated jamb stud and having at least one fastener port formed therein for reception therethrough of at least one securement fastener for attaching said base wall to the associated jamb stud;

a vertically elongated and inwardly extending strengthening rib subdividing said base wall;

wherein each bracket clip comprises a pair of horizontally oriented support lands extending perpendicularly from said base wall and separated by a clearance channel, said clearance channel linearly aligned with and perpendicular to said inwardly extending strengthening rib;

wherein each bracket clip further includes a pair of flanges having planar surfaces oriented perpendicular to said base wall and said pair of support lands, each of which cooperate to form a three-sided pocket; and a header stud sized for substantial slide-fit reception into the interior of the three-sided pocket for supported mounting therein on said respective pair of bracket clip support lands, said header stud mounts flush with said flanges and in a manner that prohibits respective outward transverse movement of a pair of header stud sidewalls.

9. The combination of claim 8, wherein the header stud includes a hollow interior configured for longitudinal endwise slide-in reception of a reinforcing sleeve.

10. The combination of claim 8, wherein the header stud comprises a web having a pair of end walls turned at right angles at opposite margins thereof.

11. The combination of claim 10, wherein the end walls include a pair of respective short side strips in-turned parallel to said web and defining an elongated slot therebetween, wherein said web, said end walls and said short side strips form a partially enclosed channel configured to receive the reinforcing sleeve.

12. The combination of claim 11, wherein said reinforcing sleeve includes a reinforcing rib received by said elongated slot.

13. The combination of claim 8, including a pair of alignment fasteners for attaching said base wall to said associated jamb stud to accommodate vertical positional adjustment of said bracket clip and said header stud relative to said jamb stud while simultaneously preventing horizontal movement thereof.

14. The bracket clip of claim 13, including a pair of securement fasteners for precision securement of said bracket clips to respective jamb studs without permitting positional adjustment.

15. A method of building a framed opening in a building wall having a pair of vertically oriented jamb studs at opposite sides of the framed opening, comprising the steps of:

aligning a pair of bracket clips to respective jamb studs at selected vertical positions lining an inboard side of the framed opening, said bracket clips each having a pair of horizontally oriented support lands extending from a base wall and separated by an edge accessible slide channel, said base wall having at least one slot and a pair of planar surface parallel flanges oriented perpendicular to said base wall and said pair of support lands, each of which cooperate to form a three-sided pocket;

inserting a securement fastener into at least one slot in the base walls to attach said pair of bracket clips to said associated jamb studs; and sliding respective ends of a header stud into each bracket clip three-sided pocket in a manner that said pair of support lands vertically support the header stud and said flanges prohibit outward transverse movement of said header stud sidewalls, wherein the sliding step includes the step of sliding an edge of said header stud under a vertically elongated strengthening rib extending into the interior of said three-sided pocket.

16. The method of claim 15, wherein the sliding step includes the step of sliding the header stud into said three-sided pocket.

17. The method of claim 15, including the step of fastening the header stud to said bracket clips.

18. The method of claim 15, wherein said aligning step includes the step of securing said base wall to the associated jamb stud with a positioning fastener that permits vertical movement of said bracket clip and said header stud while simultaneously preventing horizontal positional movement.

19. The method of claim 15, including the step of positioning said base wall flush with the associated jamb stud.

* * * * *